US007905703B2

(12) United States Patent
Cruickshank et al.

(10) Patent No.: US 7,905,703 B2
(45) Date of Patent: Mar. 15, 2011

(54) CENTRIFUGAL COMPRESSOR RETURN PASSAGES USING SPLITTER VANES

(75) Inventors: Joseph Cruickshank, Menasha, WI (US); Shreekant Shah, Appleton, WI (US)

(73) Assignee: General Electric Company, Schenectady, NY (US)

( * ) Notice: Subject to any disclaimer, the term of this patent is extended or adjusted under 35 U.S.C. 154(b) by 918 days.

(21) Appl. No.: 11/750,050

(22) Filed: May 17, 2007

(65) Prior Publication Data

US 2008/0286095 A1 Nov. 20, 2008

(51) Int. Cl.
*F04D 29/44* (2006.01)

(52) U.S. Cl. ..... 415/199.2; 415/208.2; 415/211.1

(58) Field of Classification Search ..... 415/181, 415/207, 208.2, 208.4, 209.4, 210.1, 211.1, 415/187, 199.1, 199.2; 416/183, 124
See application file for complete search history.

(56) References Cited

U.S. PATENT DOCUMENTS 2,373,713 A * 4/1945 Shoults ..... 415/115
3,017,837 A * 1/1962 Judd ..... 415/172.1
3,039,736 A * 6/1962 Lemuel ..... 416/90 R
3,184,152 A * 5/1965 Bourquard ..... 415/181
3,644,055 A 2/1972 Davis
3,930,746 A 1/1976 Kronogard
3,936,223 A 2/1976 Baghdadi
4,012,166 A 3/1977 Kaesser et al.
4,027,997 A 6/1977 Bryans
4,100,732 A 7/1978 Bryans et al.
4,302,150 A 11/1981 Wieland
4,338,063 A 7/1982 Nakanishi
4,349,314 A 9/1982 Erwin
4,354,802 A * 10/1982 Nishida et al. ..... 415/207
4,431,374 A 2/1984 Benstein et al.
4,538,410 A 9/1985 Klaebo
4,549,847 A 10/1985 Stroem et al.
4,573,868 A 3/1986 Stroem et al.
4,576,550 A 3/1986 Bryans
4,579,509 A 4/1986 Jacobi
4,611,969 A 9/1986 Zinsmeyer
4,629,403 A 12/1986 Wood
4,642,026 A 2/1987 Ruff
4,695,224 A * 9/1987 Lown ..... 415/116
4,737,071 A 4/1988 Horn, Jr.
4,740,138 A 4/1988 Zaehring et al.
4,770,605 A 9/1988 Nakatomi
4,815,935 A 3/1989 Gottemoller
4,844,690 A 7/1989 DeLaurier et al.
4,854,126 A 8/1989 Chevis et al.
4,859,145 A 8/1989 Sidransky
4,877,370 A 10/1989 Nakagawa et al.
4,877,373 A * 10/1989 Bandukwalla ..... 415/208.4
4,900,225 A 2/1990 Wulf et al.
4,969,798 A 11/1990 Sakai et al.
5,143,514 A 9/1992 Adachi
(Continued)

FOREIGN PATENT DOCUMENTS

DE 195 48 852 A1 12/1995
(Continued)

*Primary Examiner* — Igor Kershteyn
(74) *Attorney, Agent, or Firm* — Potomac Patent Group PLLC

(57) ABSTRACT

A return section in a multistage centrifugal compressor includes a plurality of circumferentially positioned flow vanes, and a plurality of splitter vanes disposed between the flow vanes. The splitter vanes serve to minimize or eliminate regions of reverse or separated flow, resulting in improved compressor performance.

20 Claims, 5 Drawing Sheets

U.S. PATENT DOCUMENTS

| | | | | |
|---|---|---|---|---|
| 5,178,516 | A | | 1/1993 | Nakagawa et al. |
| 5,266,002 | A | | 11/1993 | Brasz |
| 5,310,309 | A | | 5/1994 | Terasaki et al. |
| 5,316,441 | A | * | 5/1994 | Osborne ..... 415/208.4 |
| 5,342,183 | A | | 8/1994 | Rafalovich et al. |
| 5,387,081 | A | | 2/1995 | LeBlanc |
| 5,445,496 | A | | 8/1995 | Brasz |
| 5,516,263 | A | | 5/1996 | Nishida et al. |
| 5,529,457 | A | | 6/1996 | Terasaki et al. |
| 5,709,531 | A | | 1/1998 | Nishida et al. |
| 5,807,071 | A | | 9/1998 | Brasz et al. |
| 5,845,482 | A | | 12/1998 | Carscallen |
| 6,129,511 | A | | 10/2000 | Salvage et al. |
| 6,155,777 | A | | 12/2000 | Aschenbruck et al. |
| 6,200,094 | B1 | | 3/2001 | Skoch et al. |
| 6,203,275 | B1 | | 3/2001 | Kobayashi et al. |
| 6,210,104 | B1 | | 4/2001 | Schonenborn |
| 6,220,234 | B1 | | 4/2001 | Baker et al. |
| 6,382,912 | B1 | | 5/2002 | Lee et al. |
| 6,540,481 | B2 | | 4/2003 | Moussa et al. |
| 6,547,520 | B2 | | 4/2003 | Zinsmeyer et al. |
| 6,554,569 | B2 | | 4/2003 | Decker et al. |
| 7,101,151 | B2 | | 9/2006 | Loringer et al. |

FOREIGN PATENT DOCUMENTS

| | | | |
|---|---|---|---|
| EP | 0 305 879 | A2 | 6/1988 |
| EP | 0 538 753 | A1 | 10/1992 |

* cited by examiner

CENTRIFUGAL COMPRESSOR RETURN PASSAGES USING SPLITTER VANES

BACKGROUND OF THE INVENTION

The invention relates to centrifugal compressors and, more particularly, to structure in a multistage centrifugal compressor that serves to minimize or eliminate regions of reverse or separated flow, resulting in improved compressor performance.

The return passage in a multistage centrifugal compressor normally consists of a number of similar vanes or airfoils of similar geometry. For certain flow conditions, these vanes are required to turn the flow significantly, possibly resulting in flow separation in the return vanes and degradation of compressor performance.

In low flow coefficient multistage compressor designs, the flow angle going into the return vanes can be very low due to high tangential components of flow. Regardless, the vanes must eliminate the tangential component of velocity before the flow goes into the following stage. Diffuser ratios also tend to be low.

The elimination of the tangential or whirl component must therefore take place over a relatively short distance. Because of the high tangential component, this results in turning the flow from a mostly tangential flow to a radial flow in a very short distance. These requirements can lead to flow separation and performance degradation.

BRIEF DESCRIPTION OF THE INVENTION

In an exemplary embodiment, a return section in a multistage centrifugal compressor includes a plurality of circumferentially positioned flow vanes, and a plurality of splitter vanes disposed between the flow vanes.

In another exemplary embodiment, a return section in a multistage centrifugal compressor includes a plurality of circumferentially positioned flow vanes, and flow modifying structure interposed between each of the flow vanes, the flow modifying structure serving to minimize regions of reverse or separated flow.

In yet another exemplary embodiment, a return section in a multistage centrifugal compressor includes a plurality of circumferentially positioned airfoil shaped flow vanes, and a plurality of airfoil shaped splitter vanes interposed between the flow vanes, the splitter vanes being of a different geometry than the flow vanes and serving to minimize regions of reverse or separated flow.

DETAILED DESCRIPTION OF THE INVENTION

Figure 1:
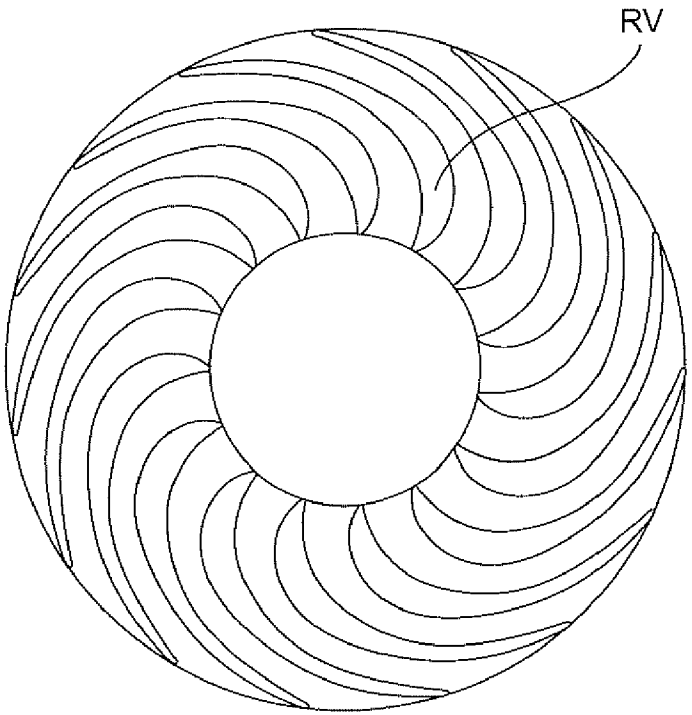
FIG. 1 (PRIOR ART)
FIG. 1 shows a return section in a multistage centrifugal compressor including conventional return vanes.

FIG. 1 shows a return section in a multistage centrifugal compressor including conventional return vanes RV. In a typical design, the return section includes several, e.g., fifteen or so, circumferentially positioned flow vanes RV. With reference to the background described above, it would be desirable to improve compressor performance by eliminating or minimizing separated flow regions to thereby improve performance of a multistage compressor.

Figure 2:
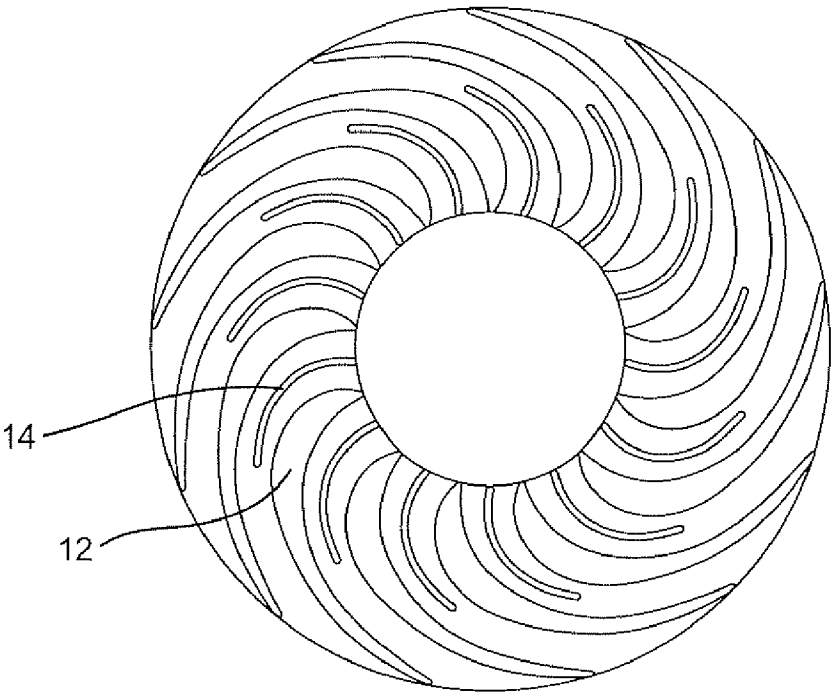
FIG. 2 shows a return section including splitter vanes.

With reference to FIG. 2, in an exemplary embodiment, flow modifying structure is interposed between each of the flow vanes, which structure serves to better control the flow turning and minimize regions of reverse or separated flow. The return section includes a plurality of circumferentially positioned flow vanes 12, and the flow modifying structure includes a plurality of splitter vanes 14 disposed between the flow vanes 12. The splitter vanes 14 are preferably but need not be formed of a different geometry than the flow vanes 12 and are disposed in alternating positions between the flow vanes 12. The number of vanes 12, 14 and corresponding geometry are selected and analyzed to ensure that regions of flow separation in the return section are minimized or eliminated. In one exemplary preferred embodiment, the return section includes thirteen flow vanes 12 and thirteen splitter vanes 14.

Figure 3:
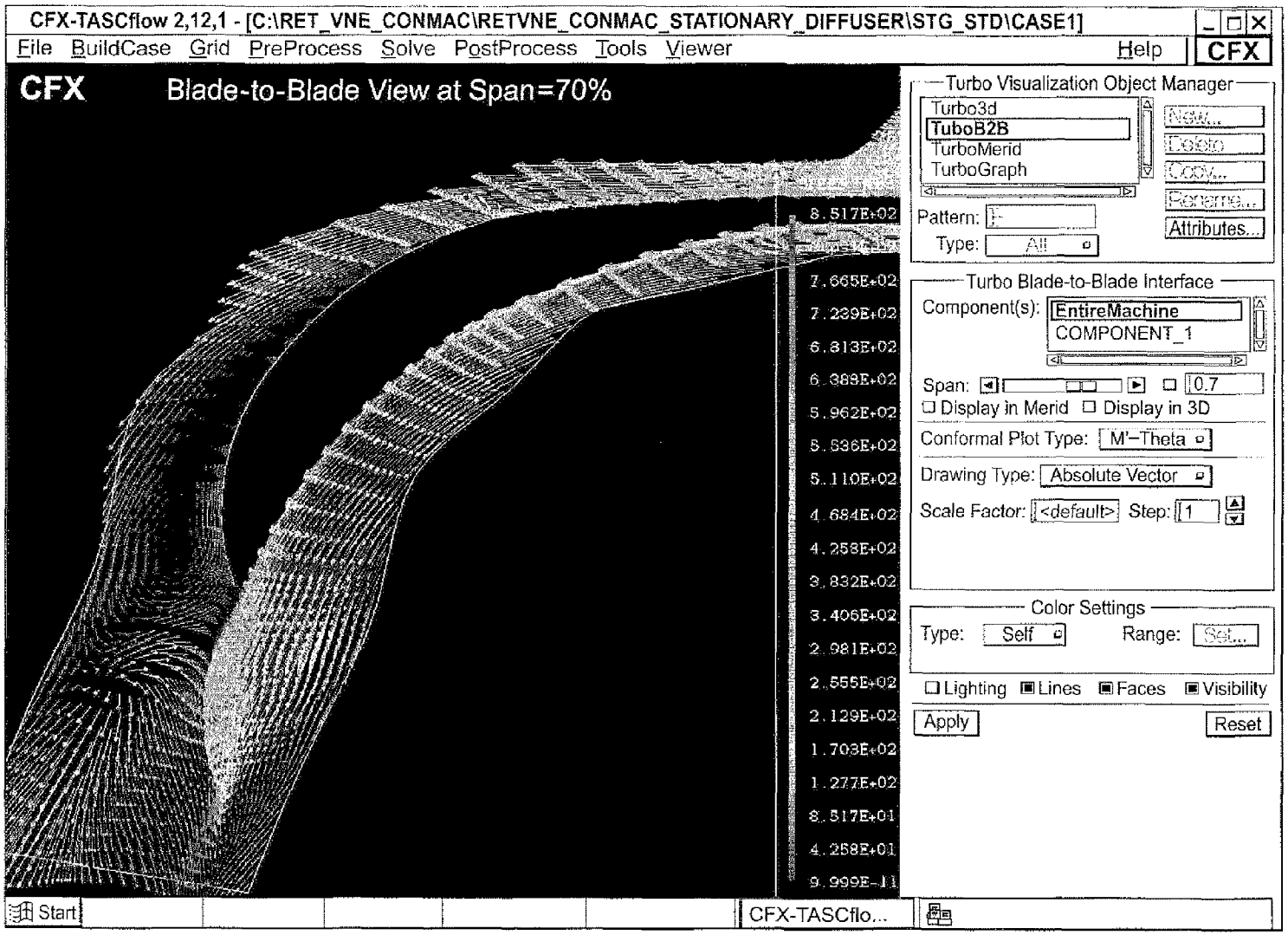
FIGS. 3 and 4 are meridional velocity plots showing a comparison between the conventional design and the design including splitter vanes.
Figure 4:
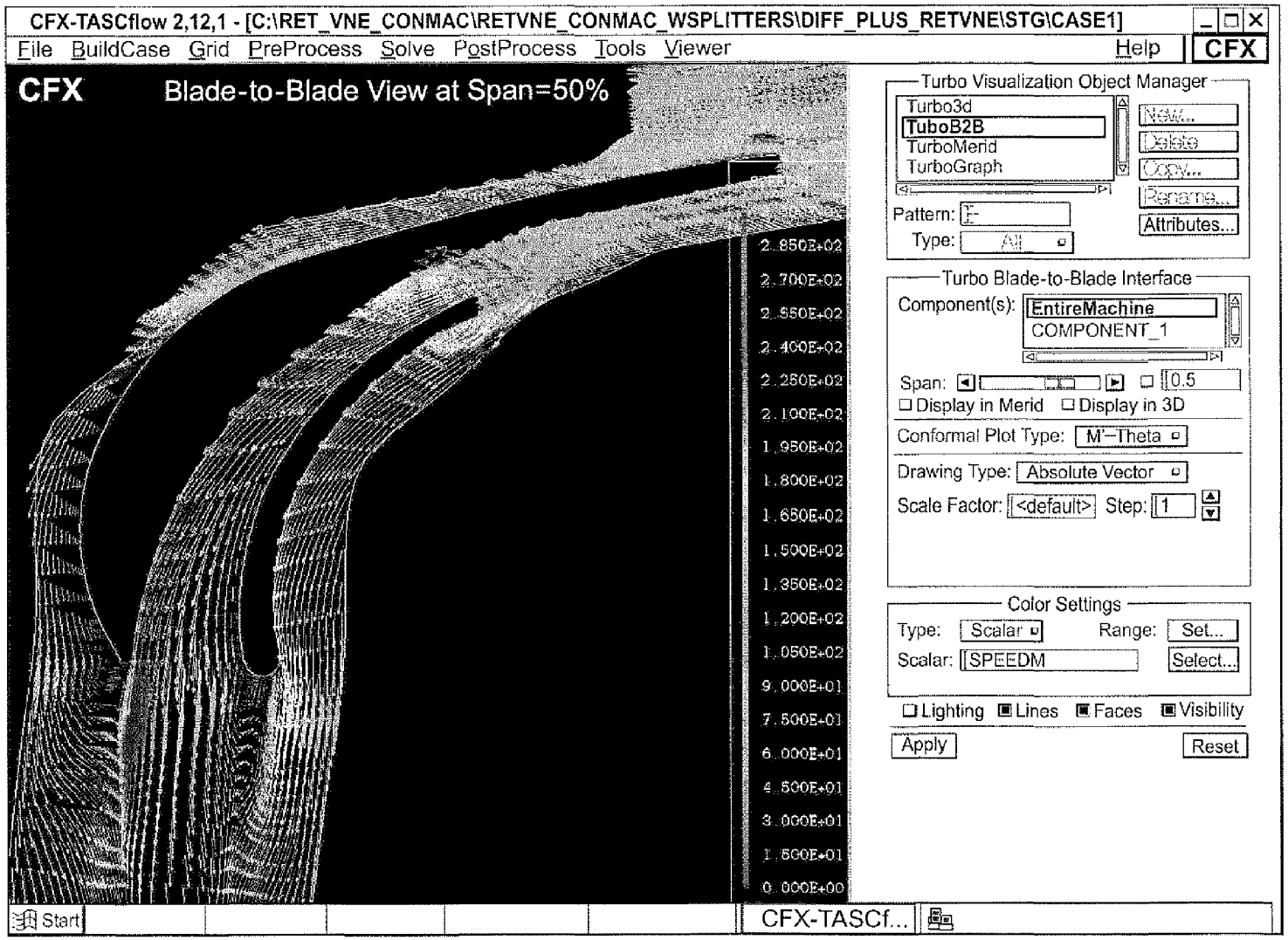

With reference to FIGS. 3-6, computational fluid dynamics calculations have been performed to verify that this structure achieves an improvement over conventional approaches. FIG. 3 shows a plot of the meridional velocity on the vane surface without a splitter present. A separation bubble is clearly visible on the upper surface of the vane. With reference to FIG. 4, the insertion of the splitter eliminates this bubble almost completely and thus eliminates a potential source of instability and poor performance.

Figure 5:
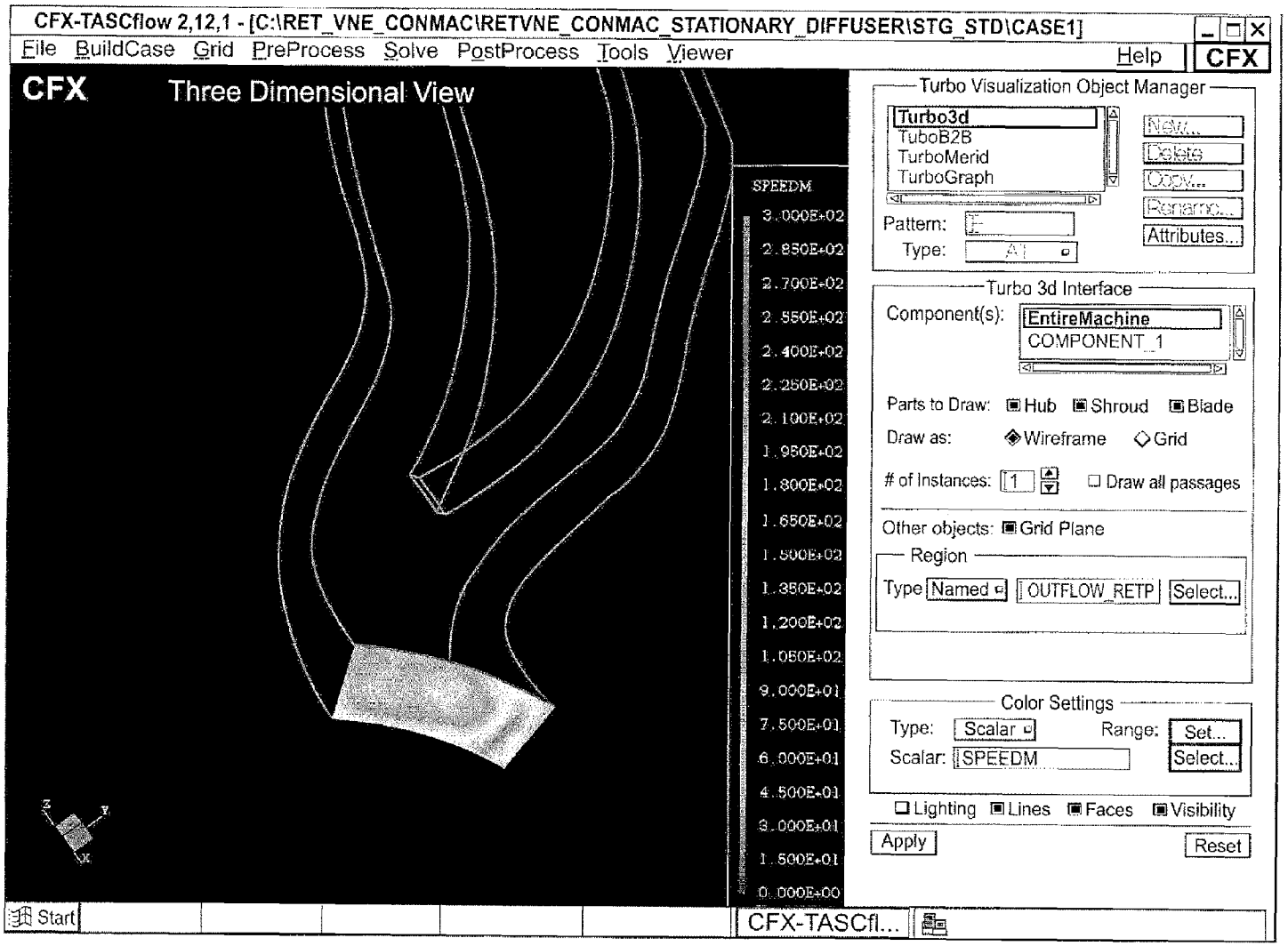
FIGS. 5 and 6 are meridional velocity fringe plots at an inlet of the stage following the return vanes with the conventional design and the design including the splitter vanes, respectively.
Figure 6:
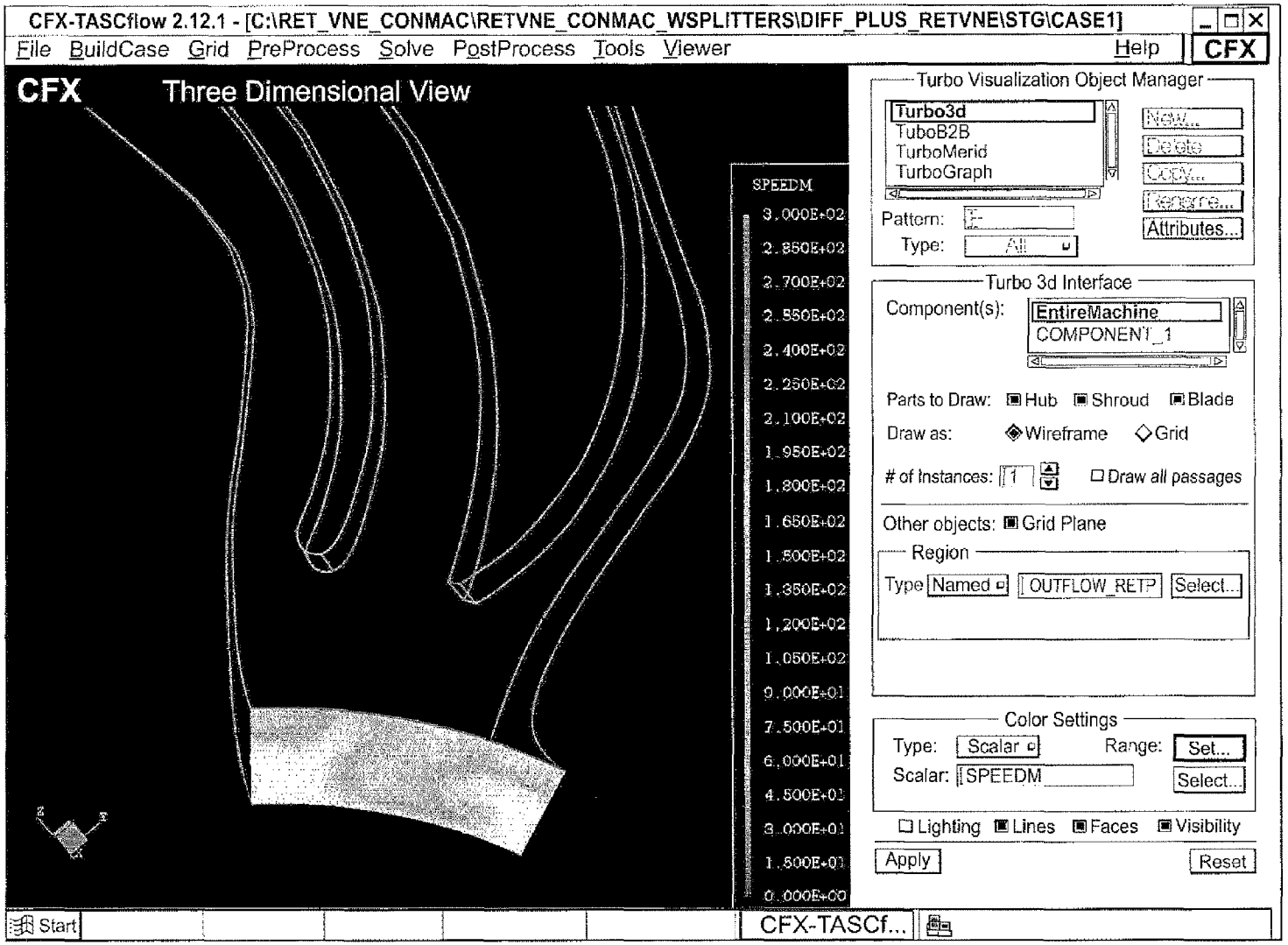

FIG. 5 shows a fringe plot of the meridional velocity approaching the next stage impeller without the splitters present. FIG. 6 has the splitters. FIG. 6 shows that the flow approaching the next stage is much more uniform, a desirable feature for good performance.

From a comparison of the plots, it is shown that the splitter vanes 14 have produced minimal re-circulation compared with the standard design. Moreover, the velocity distribution at a next stage impeller inlet is more uniform. The flow angle calculations (mass averaged) at the outlet of the return vanes show that the return vanes with splitters provide about 5° more turning of the flow than the standard return vane. As a consequence, regions of reverse or separated flow are minimized or eliminated, resulting in improved compressor performance.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A return section in a multistage centrifugal compressor, the return section comprising:

a plurality of circumferentially positioned flow vanes in the return section arranged to turn an incoming flow with a substantial tangential or whirl component of velocity to a substantially radial flow, the plurality of flow vanes being configured to minimize separated flow regions while substantially eliminating the tangential or whirl component of flow velocity; and a plurality of splitter vanes disposed between the flow vanes in the return section and configured to minimize the separated flow regions, wherein the return section, the plurality of flow vanes and the plurality of splitter vanes are positioned between two stages of the multistage centrifugal compressor.

2. A return section according to claim 1, wherein the flow vanes comprise an airfoil shape.

3. A return section according to claim 1, wherein the splitter vanes comprise a different geometry than the flow vanes.

4. A return section according to claim 3, wherein the splitter vanes are shorter than the flow vanes.

5. A return section according to claim 1, wherein a number and a geometry of the splitter vanes are selected to minimize regions of flow separation.

6. A return section according to claim 5, comprising thirteen flow vanes and thirteen splitter vanes.

7. A return section according to claim 1, wherein the flow vanes and the splitter vanes are alternately disposed.

8. The return section of claim 1, further comprising:

opposite walls defining the return section, wherein each of the plurality of flow vanes and the plurality of splitter vanes are configured to form closed return passages together with the opposite walls.

9. The return section of claim 8, wherein a return passage is defined by the opposite walls, one flow vane and one splitter vane.

10. The return section of claim 1, wherein the return section is provided between a diffuser of a first stage and a second stage.

11. A return section in a multistage centrifugal compressor, the return section comprising:

a plurality of circumferentially positioned flow vanes in the return section arranged to turn an incoming flow with a substantial tangential or whirl component of velocity to a substantially radial flow, the plurality of flow vanes being configured to minimize separated flow regions; and a flow modifying structure interposed between each of the flow vanes, the flow modifying structure serving to minimize regions of reverse or separated flow and being provided in the return section, wherein the return section, the plurality of flow vanes and the flow modifying structure are positioned between two stages of the multistage centrifugal compressor.

12. A return section according to claim 11, wherein the flow modifying structure comprises a plurality of splitter vanes, one each interposed between the flow vanes.

13. The return section of claim 11, further comprising:

opposite walls defining the return section, wherein each of the plurality of flow vanes and the flow modifying structure are configured to form closed return passages together with the opposite walls.

14. The return section of claim 13, wherein a return passage is defined by the opposite walls, one flow vane and a splitter vane of the flow modifying structure.

15. The return section of claim 11, wherein the return section is provided between a diffuser of a first stage and a second stage.

16. A return section in a multistage centrifugal compressor, the return section comprising:

a plurality of circumferentially positioned airfoil shaped flow vanes in the return section arranged to turn an incoming flow with a substantial tangential or whirl component of velocity to a substantially radial flow, the plurality of airfoil shaped flow vanes being configured to minimize regions of reverse or separated flow; and a plurality of airfoil shaped splitter vanes interposed between the flow vanes in the return section, the splitter vanes being of a different geometry than the flow vanes and serving to minimize the regions of reverse or separated flow, wherein the return section, the plurality of flow vanes and the plurality of splitter vanes are positioned between two stages of the multistage centrifugal compressor.

17. The return section of claim 16, further comprising:

opposite walls defining the return section, wherein each of the plurality of flow vanes and the plurality of splitter vanes are configured to form closed return passages together with the opposite walls.

18. The return section of claim 17, wherein a return passage is defined by the opposite walls, one flow vane and one splitter vane.

19. The return section of claim 16, wherein the return section is provided between a diffuser of a first stage and a second stage.

20. The return section of claim 16, wherein the plurality of circumferentially positioned airfoil shaped flow vanes are arranged to turn an incoming flow having a substantially tangential or whirl component to a substantially radial flow exiting the return section.

* * * * *